United States Patent [19]

Kane et al.

[11] Patent Number: 4,921,435

[45] Date of Patent: May 1, 1990

[54] BLIND MATING CONNECTOR HAVING SELF-LOCATING FEATURE

[75] Inventors: Thomas J. Kane, Dearborn, Mich.; John M. Myer, Millersville; Richard W. Grzybowski, Lebanon, both of Pa.

[73] Assignees: Ford Motor Company, Dearborn, Mich.; AMP Incorporated, Harrisburg, Pa.

[21] Appl. No.: 360,812

[22] Filed: Jun. 2, 1989

[51] Int. Cl.[5] ..... H01R 13/631

[52] U.S. Cl. ..... 439/248; 29/854; 439/297

[58] Field of Search ..... 439/247, 248, 34, 544; 29/854

[56] References Cited

U.S. PATENT DOCUMENTS

| | | | |
|---|---|---|---|
| 1,842,157 | 1/1928 | Ferguson . | |
| 3,322,416 | 7/1974 | Haag et al. . | |
| 3,668,605 | 6/1972 | Albert . | |
| 3,744,128 | 7/1973 | Fisher et al. . | |
| 3,873,172 | 3/1975 | Paullus . | |
| 3,930,705 | 1/1976 | Gallagher . | |
| 4,030,797 | 6/1977 | Nieman | 439/248 |
| 4,063,683 | 12/1977 | Jones . | |
| 4,083,620 | 4/1978 | Burgin . | |
| 4,275,945 | 6/1981 | Krantz et al. . | |
| 4,277,135 | 7/1981 | Schrott et al. | 439/248 X |
| 4,350,401 | 9/1982 | Allen et al. . | |
| 4,361,372 | 11/1982 | Majkrzak et al. . | |
| 4,381,878 | 5/1983 | Lechner et al. . | |
| 4,418,975 | 12/1983 | O'Keefe, II . | |
| 4,453,797 | 6/1984 | Hollingsead et al. . | |
| 4,509,258 | 4/1985 | Locati et al. . | |
| 4,602,317 | 7/1986 | Rovnyak et al. . | |
| 4,647,130 | 3/1987 | Blair et al. . | |
| 4,653,837 | 3/1987 | Phillipson et al. . | |
| 4,655,525 | 4/1987 | Hunt, III et al. . | |
| 4,664,456 | 5/1987 | Blair et al. . | |
| 4,682,833 | 7/1987 | Ferchau et al. . | |
| 4,761,144 | 8/1988 | Hunt, III et al. . | |
| 4,787,864 | 11/1988 | Hunt, III et al. . | |
| 4,815,984 | 3/1989 | Sugiyama et al. | 439/248 X |

FOREIGN PATENT DOCUMENTS

| | | |
|---|---|---|
| 8701689 | 4/1987 | Fed. Rep. of Germany . |
| 2489609 | 7/1980 | France . |

*Primary Examiner*—Eugene F. Desmond

*Attorney, Agent, or Firm*—Mark L. Mollon; Paul K. Godwin

[57] ABSTRACT

A blind mating connector for simultaneously providing electrical and mechanical connection of an electrical component to an instrument panel is disclosed such that a robotic installation of the electrical device is possible. A floating receptacle in the panel is located at a theoretical center at which the device-end connector is expected to arrive by means of resilient O-rings contained in grooves on flanges extending from the floating receptacle. The floating receptacle is movable in any direction in the plane of the panel and is rotatable about any axis. Thus, errors in alignment and in the insertion direction of the electrical device are tolerated while ensuring a proper electrical and mechanical connection between the device and the floating receptacle.

17 Claims, 6 Drawing Sheets

BLIND MATING CONNECTOR HAVING SELF-LOCATING FEATURE

BACKGROUND OF THE INVENTION

The present invention relates in general to a connector assembly for establishing a blind connection between an electrical device and a panel, and more specifically to a floating connector block contained in an aperture on a panel having a means for movably locating the floating connector block at the theoretical center of the aperture.

This application is related to copending application Ser. No. 161,067, filed Feb. 26, 1988, now abandoned entitled "BLIND MATE SHIELDED INPUT/OUTPUT CONNECTOR ASSEMBLY", incorporated herein by reference. The prior application discloses a connector assembly useful in the robotic assembly of electrical components to an instrument panel or other panel in an automobile. A receptacle module is mounted in an aperture on a carrier panel so that the receptacle module can move in any direction within the plane of the panel. Flanges project from the receptacle module disposed on opposite sides of the carrier panel in order to retain the receptacle module within the aperture and to accept insertion and removal forces of connection.

The angular orientation of the receptacle module connector terminals substantially coincides with a direction perpendicular to the carrier panel. The panel must then be in reasonably precise relationship with the direction in which the electrical component is robotically inserted. However, it is sometimes difficult to accomplish such precise alignment in an automobile instrument panel or other panel. Also, the receptacle module tends to rest at the bottom of the aperture. Thus, even though the receptacle is free to move within the plane of the aperture, its length of travel in the downward vertical direction is depleted even before interconnection is attempted. Therefore, the acceptable error in initial alignment does not allow the inserted part to be lower than the receptacle. It would be desirable to increase the tolerable positional error to improve the manufacturability of instrument panels by robotics.

SUMMARY OF THE INVENTION

Accordingly, it is a principal object of the present invention to provide an improved connector assembly in which the floating connector block is initially maintained at the approximate center of the carrier panel aperture.

It is another object of the present invention to provide an apparatus for mechanically and electrically connecting a device to a panel in which the axis of the floating connector block is initially substantially perpendicular to the panel and is rotatable therefrom.

It is a further object of the invention to provide a method for improved robotic installation of an electrical device to a carrier panel.

It is yet another object to provide a floating connector block movable and rotatable in any direction and/or plane.

These and other objects are achieved by means of an apparatus for mechanically and electrically connecting a device to a panel. The apparatus comprises a carrier panel having an aperture therein. A floating connector block is received in the aperture. The floating connector block includes a main body and at least two pairs of longitudinally spaced flanges extending from the main body in planes parallel with the plane of the aperture. The connector block is located within the aperture so that the carrier panel is disposed in the space between the flanges of each pair. The floating connector block further includes a plurality of terminals within the main body for establishing electrical connections. The terminals are substantially perpendicular to the flanges. A plurality of resilient support strips extend between the flanges of each of the pairs of flanges such that the strips are tensioned under contact with the carrier panel and tend to locate the floating connector block at a desired position within the aperture. The flanges are sufficiently spaced to allow a small amount of rotation of the floating connector block about any axis. A device-end connector is included on the component being connected to the panel and includes a plurality of pins arranged for matable connection to the block terminals. A guide means is provided on the floating block and the device-end connector for aligning the pins and the block terminals when the device-end connector and the floating connector block are brought together. Preferably, the resilient strips are comprised of elastomeric O-rings received in grooves on each respective pair of flanges.

The invention further provides a method for installing an electrical device to a carrier panel, comprising the steps of: (1) inserting the floating block into the aperture of the carrier panel such that the carrier panel is disposed between the flanges of each of the pairs of flanges and the resilient strips are tensioned under contact with the panel and the flanges; (2) orienting the device and the carrier panel such that the block terminals and the pins are substantially aligned; and (3) joining the device-end connector and the floating block by relative axial movement until the pins and the terminals are coupled.

BRIEF DESCRIPTION OF THE DRAWINGS

The novel features of the invention are set forth with particularity in the appended claims. The invention itself, however, both as to its organization and method of operation, together with further objects and advantages thereof, may best be understood by reference to the following description taken in conjunction with the accompanying drawings, in which:

DETAILED DESCRIPTION OF THE PREFERRED EMBODIMENTS

Figure 1:
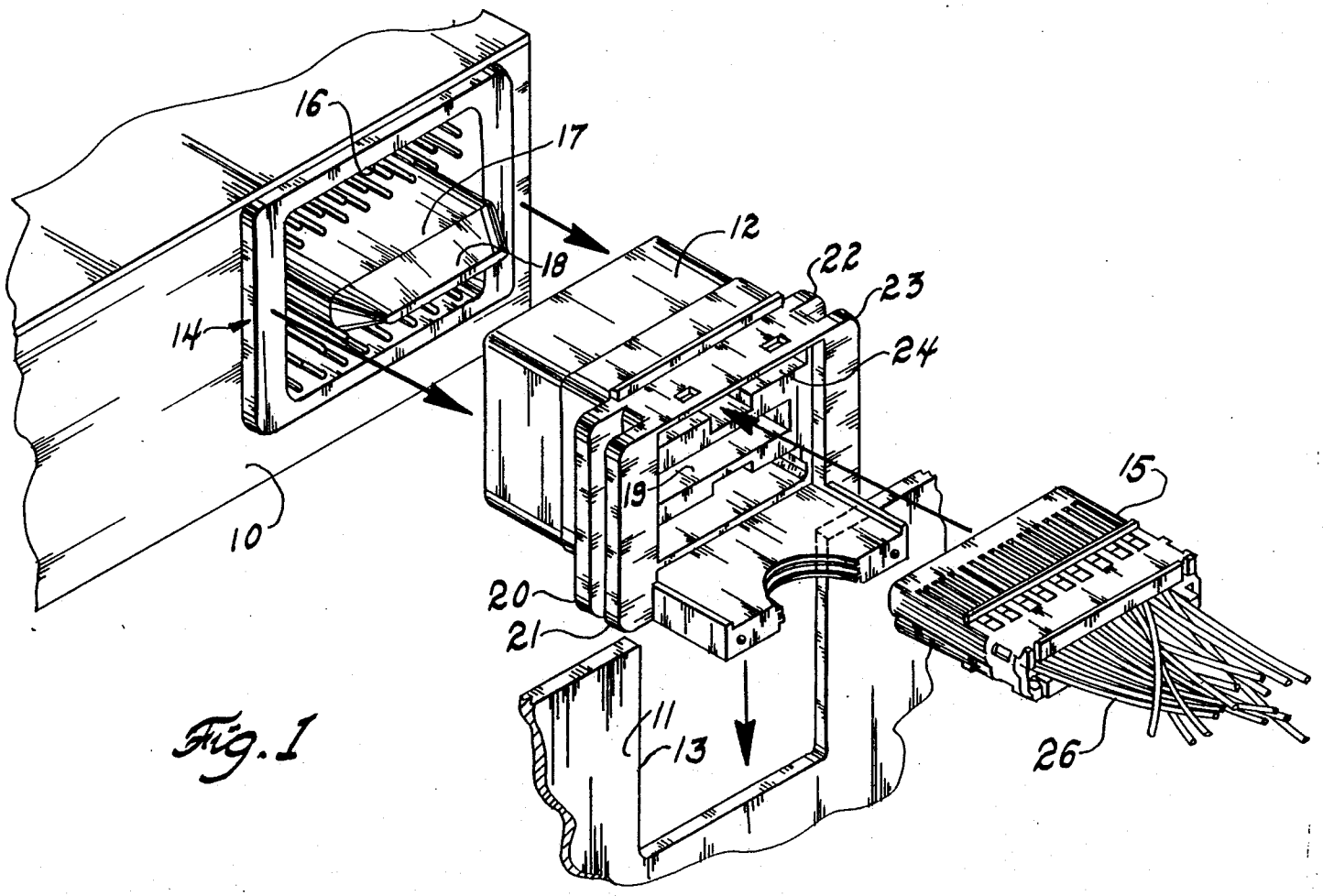
FIG. 1 is an exploded perspective view of a connector assembly according to the related application.
Figure 2:
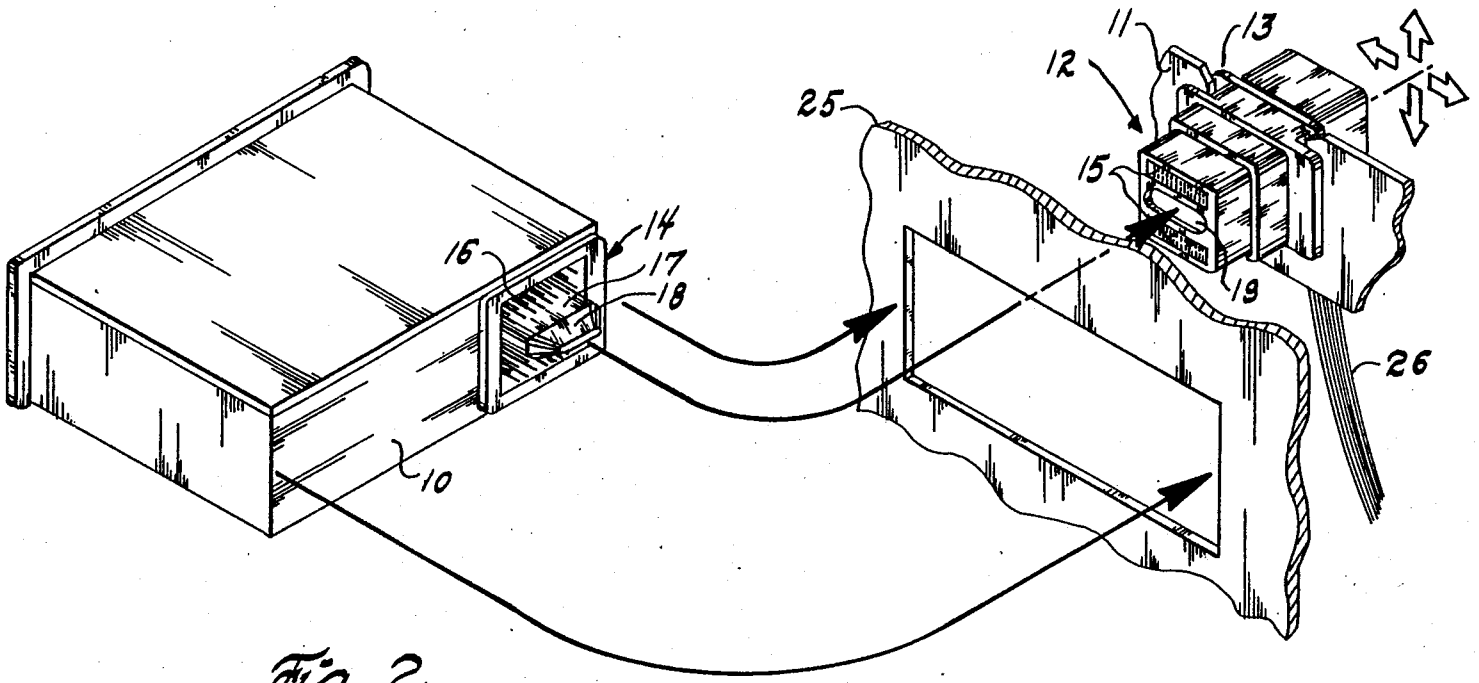
FIG. 2 is a perspective view showing connection of the connector assembly of the related application.
Figure 3:
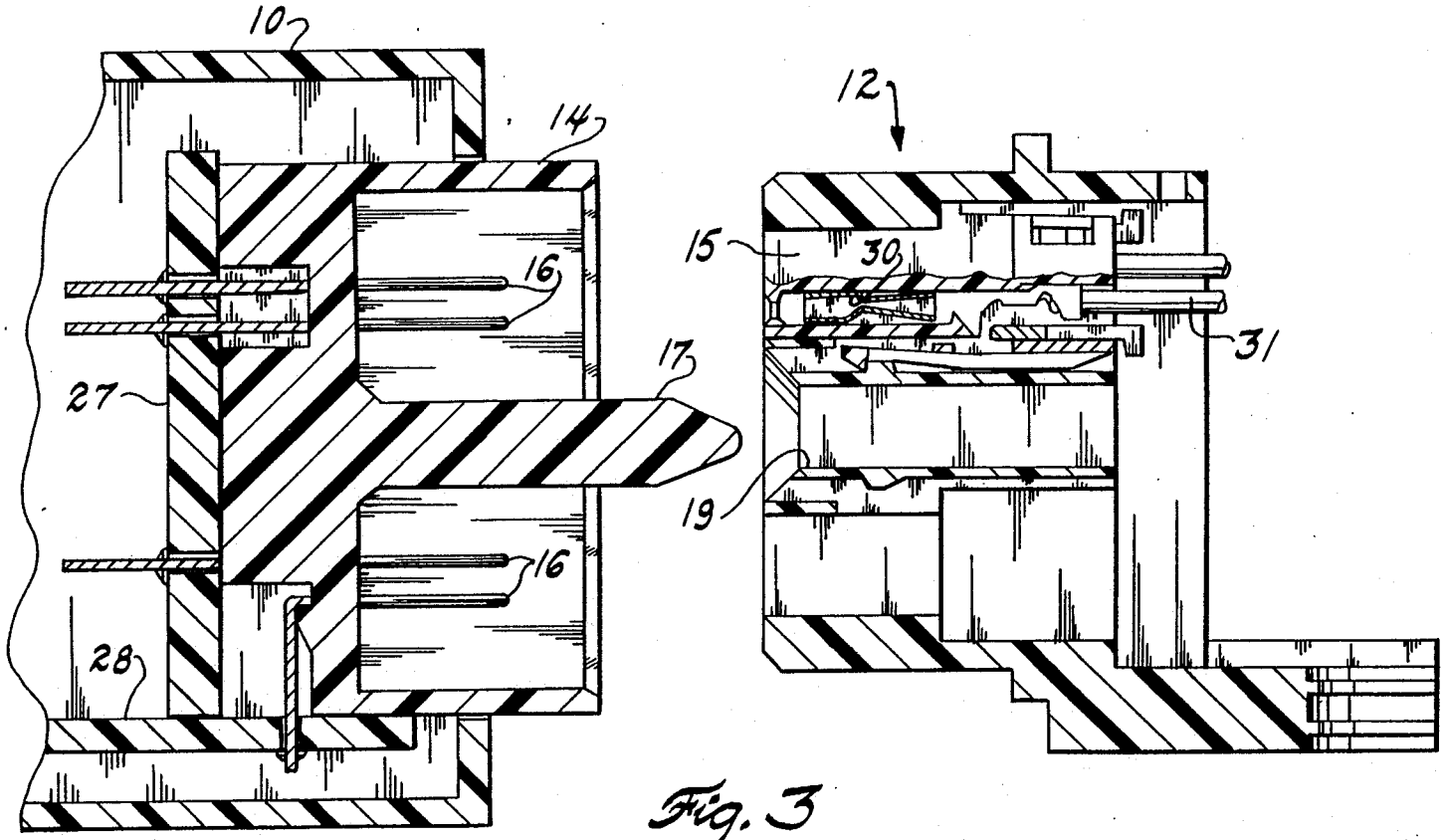
FIG. 3 is a cross-sectional view of the device-end connector and the floating connector block of the related application.

FIGS. 1–3 are illustrative of the connector assembly disclosed in application Ser. No. 161,067.

FIG. 1 illustrates an electrical device 10 which is desired to be interconnected with an instrument panel 11. A floating connector block 12 is suspended in an aperture 13 for interconnecting with a device-end connector 14. Floating block 12 includes an aperture 24 for receiving an electrical connector 15 which includes a plurality of terminal sockets 30 (FIG. 3) for connection to pins 16 of device-end connector 14. As shown in FIG. 3, male pins 16 are connected to circuit boards 27 and 28 in electrical device 10. Female terminals 30 are connected to individual lead wires 31 that together form a wire bundle. Alternatively, floating block 12 can be manufactured having electrical connectors embedded therein, rather than having a separate female connector block inserted into a receiving aperture 24. Furthermore, unique terminals can be provided in block 12, including terminals for coaxial wires or other shielded wiring.

Device-end connector 14 further includes a projection 17 having a beveled surface 18 for insertion into an aperture 19 in floating block 12 with a similar beveled surface (FIG. 3) for the purpose of guiding and aligning the insertion of pins 16 into connector terminals 30. A plurality of projection-aperture pairs may also be employed, if desired. Floating movement of floating block 12 is provided by means of a plurality of flanges including a first pair of flanges 20 and 21 and a second pair of flanges 22 and 23, each pair being spaced sufficiently to allow panel 11 to be disposed therebetween and to allow movement of block 12 in the plane of the panel.

As shown in FIG. 2, it is desired to insert an electrical device 10, such as for example, a radio, an instrument cluster, or a heater control unit, into an instrument panel having a front surface 25 and a rear panel 11. As device 10 is inserted through an aperture in front surface 25, the beveled surface 18 of projection 17 enters aperture 19 in floating block 12 in order to align pins 16 with female terminals 30 (FIG. 3). Female terminals 30 are connected to a wire bundle 26 that leads to other electrical devices in a vehicle.

As indicated in FIG. 2, floating block 12 is free to move within the plane of panel 11. However, this structure, as disclosed in U.S. application Ser. No. 161,067, is subject to the difficulty that prior to interconnection with device 10, floating block 12 is located at the lower extent of its travel in aperture 13 and further downward movement is not possible during interconnection. Therfore, any error in alignment which causes projection 17 to be lower than aperture 19 prevents proper connection of device 10 to block 12.

Although the spacing of flanges 20–21 and 22–23 is sufficient to provide limited lateral movement in any direction in the plane of panel 11, it is not sufficient to allow any rotation of floating block 12 outside of the plane of panel 11. Therefore, the successful interconnection of pins 16 and female terminals 30 is uncertain since the orientation of panel 11 and front face 25, as well as the control over the insertion path of device 10, are difficult to control within the tolerances of the floating connector.

Figure 4:
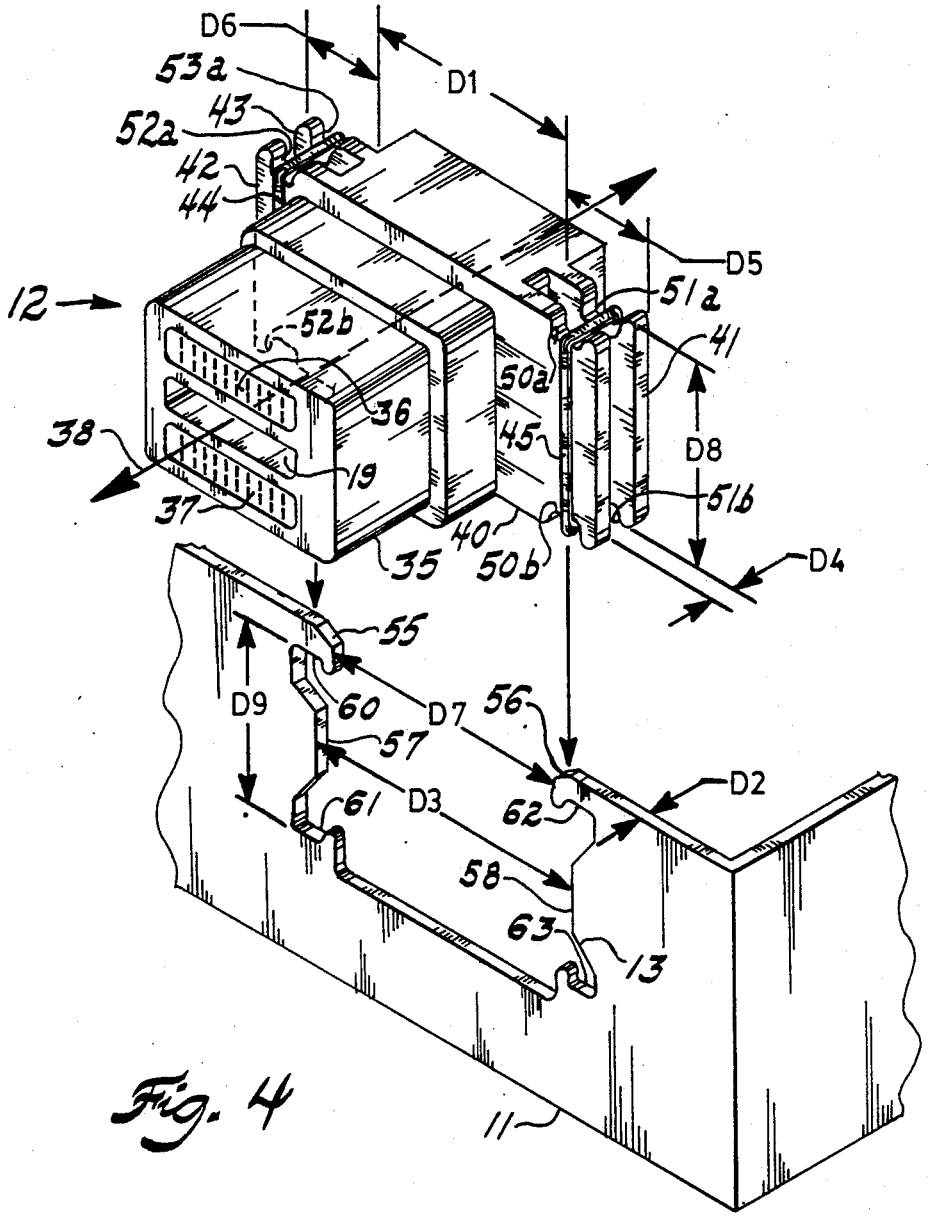
FIG. 4 is a perspective view showing the improved self-locating feature of the floating connector block of this invention.

FIG. 4 illustrates improvements according to the invention that solve the foregoing difficulties. Floating connector block 12 has a main body 35 and defines a longitudinal axis 38. Central aperture 19 extends in the direction of the defined longitudinal axis 38. Apertures 36 and 37 on either side of aperture 19 are adapted to receive female terminal connectors as described with reference to FIG. 1. Main body 35 has a lateral dimension $d_1$ and is adapted to be received in an aperture 13 formed in carrier panel 11. Aperture 13 has a lateral dimension $d_3$ which is greater than $d_1$.

Carrier panel 11 has a thickness $d_2$, at least in the vicinity of aperture 13. A pair of flanges 40 and 41 and a pair of flanges 42 and 43 extend from either side of main body 35 and are each spaced apart to receive carrier panel 11 therebetween. Each pair of flanges is spaced apart by a distance $d_4$ which is greater than carrier panel thickness $d_2$ by an amount sufficient to allow rotation of floating block 12 around any axis. Flanges 40 and 41 extend a distance $d_5$ from main body 35 and flanges 42 and 43 extend a distance $d_6$ from main body 35. The sum of $d_1$, $d_5$ and $d_6$ is greater than $d_3$ so that the flanges provide stops for movement of main body 35 along longitudinal axis 38, thereby providing a means for accepting insertion and removal forces during interconnection and disconnection of the assembly.

Each flange has a height dimension $d_8$. Respective upper and lower receiving grooves **50*a* and 50*b*, 51*a* and 51*b*, 52*a* and 52*b*, and 53*a* (and groove 53*b*, not shown) are formed in corresponding upper and lower edges of the flanges. A resilient component 44 formed of an elastomer material is disposed within receiving grooves 52*a*, 52*b*, 53*a*, and 53*b* of flanges 42 and 43. An identical component 45 is retained within grooves 50*a*, 50*b*, 51*a*, and 51*b* of flanges 40 and 41. In a preferred embodiment, resilient components 44 and 45 are comprised of O-rings which are self-retaining in the receiving grooves. Alternatively, components 44 and 45** may be formed by strips attached to and suspended between the flanges.

Aperture 13 includes a pair of upper tabs 55 and 56 separated by a distance $d_7$ which is less than $d_3$, the upper surface of tabs 55 and 56 being sloped as shown. The edge of aperture 13 includes abutment surfaces 60 and 61 which are in contact with portions of O-ring 44, and abutment surfaces 62 and 63 which are in contact with portions of O-ring 45 when floating block 12 is inserted into aperture 13. The abutment surfaces are vertically spaced by a distance $d_9$ which is less than $d_8$ and is less than the vertical spacing of the upper and lower grooves in the flanges. The O-rings are tensioned under contact with the abutment surfaces such that floating block 12 is located at the theoretical center of aperture 13 while allowing movement of floating block 12 in the plane of panel 11 and allowing slight rotation about any axis. Aperture 13 also includes a pair of tongues 57 and 58 which provide a large contact surface between carrier panel 11 and flanges 40–43 during insertion and removal of device-end connector 14. The sloped upper surfaces of tabs 55 and 56 and tongues 57 and 58 allow for the installation of floating block 12 into aperture 13 with O-rings 44 and 45 already in place. Contact between O-rings 44 and 45 and tabs 55 and 56 retracts the O-rings during downward insertion of floating block 12 into aperture 13.

Figure 6:
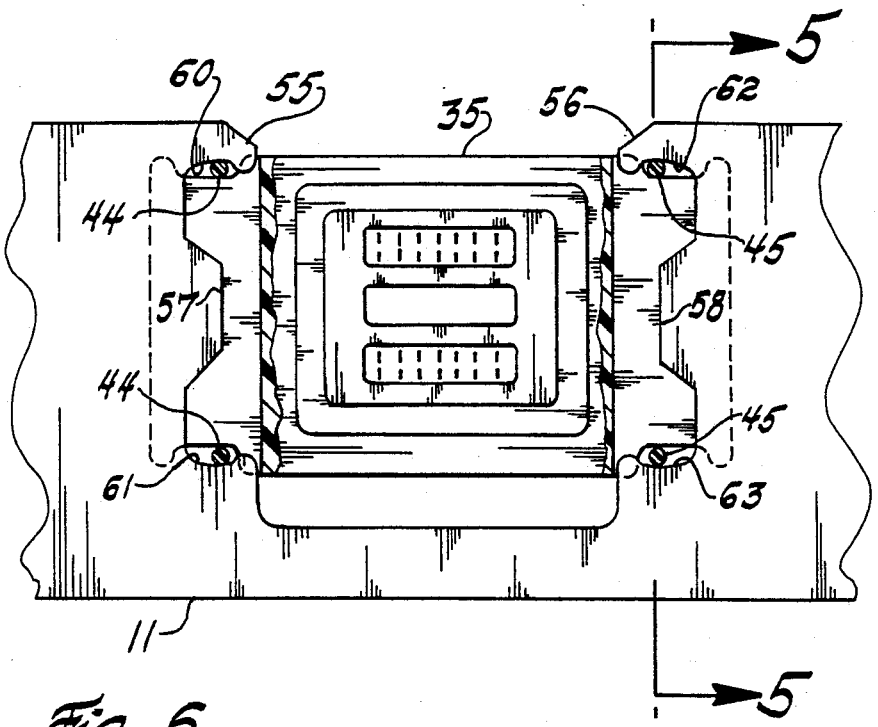
FIG. 6 is a cross-sectional view taken through the carrier panel.
Figure 5:
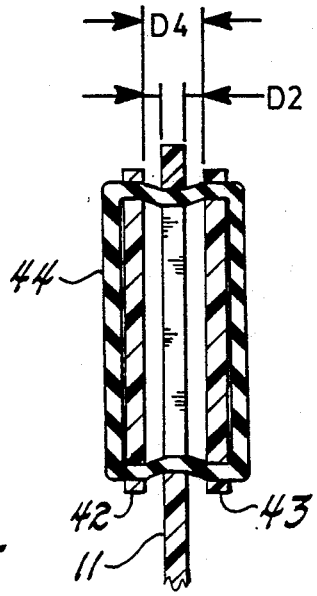
FIG. 5 is a cross-sectional view taken between the O-ring and the main body of the floating connector block and looking away from the main body.

FIG. 5 is a sectional view of an O-ring as seen from the main body 35, showing the location of flanges 42 and 43 in a spaced relationship from panel 11. FIG. 6 shows O-ring 44 in contact with abutment surfaces 60 and 61, and O-ring 45 in contact with abutment surfaces 62 and 63. As a result, main body 35 is located at the theoretical center of the aperture.

It may be desirable to configure flanges 40–43 on floating block 12 in a staggered relationship so that the flanges on one side of block 12 do not overlap longitudinally. By keeping the flanges offset, floating block 12 can be formed by a simple injection molding process without the use of cams. Manufacture of block 12 can thus be made less expensive and time consuming.

Figure 7:
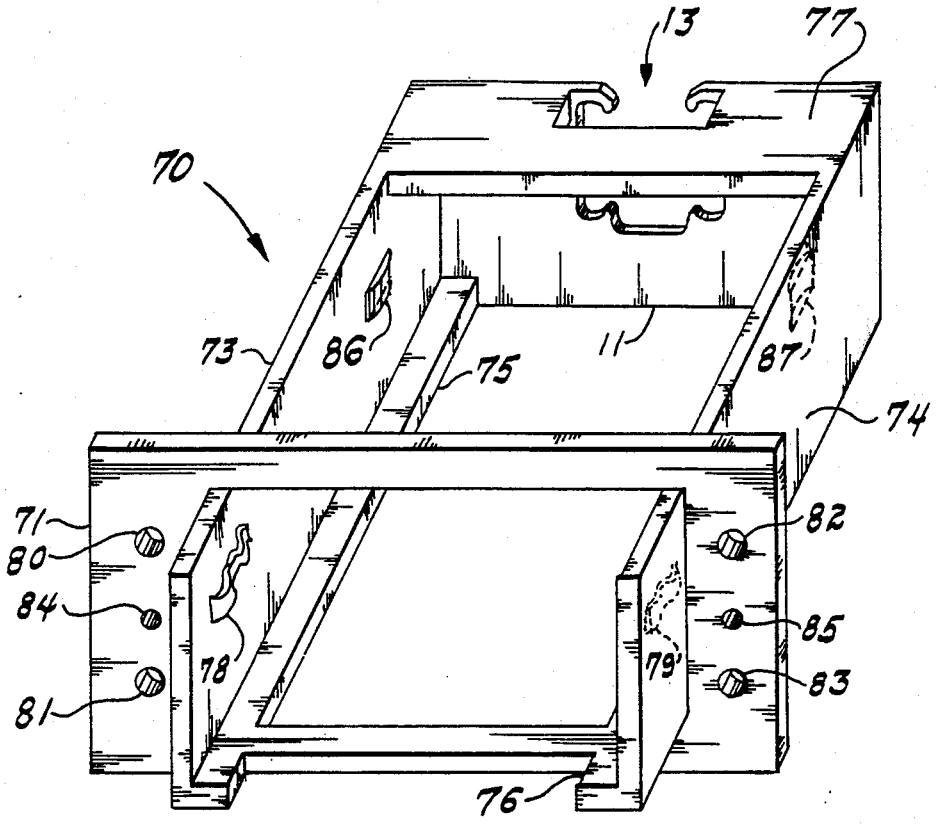
FIG. 7 is a perspective view of a tray or chest-and-drawer type carrier panel for receiving the floating connector block and the electrical device to be connected thereto.

An improvement of the blind mating capabilities of the invention is achieved using a tray 70 as shown in FIG. 7. A front face 71 includes screw holes 80–83 and locator holes 84 and 85 for attaching tray 70 to front face 25 of an instrument panel or other panel (see FIG. 2). A pair of side walls 73 and 74 extend back to carrier panel 11 with integrally molded springs 86 and 87 to center electrical device 10 in the left-right direction with aperture 13. A pair of ledges 75 and 76 extend along the bottom of side panels 73 and 74 and provide a sliding surface for the electrical device. A top extension 77 extends between the tops of side panels 73 and 74.

During insertion of electrical device 10, it is supported by ledges 75 and 76 and guided by side panels 73 and 74 and ledges 75 and 76 to more nearly align the connectors. Thus, a more reliable interconnection can be made using robotics.

To ensure that a device installed in tray 70 is retained there, a pair of retaining springs 78 and 79 extend from side panels 73 and 74, respectively. During insertion of the electrical device into the tray, springs 78 and 79 are compressed such that the device slides past. Upon full insertion of the device, springs 78 and 79 nest in receiving holes (not shown) provided in the sides of the electrical device. Alternatively, the springs can be attached to the sides of device 10 and receiving holes can be formed in side panels 73 and 74.

It can thus be seen that the present invention has achieved the objects as previously set forth. Using the described connector, electrical devices can be installed to an instrument panel or other panels at high efficiency and with low cost and a low failure rate.

While preferred embodiments of the invention have been shown and described herein, it will be understood that such embodiments are provided by way of example only. Numerous variations, changes, and substitutions will occur to those skilled in the art without departing from the spirit of the invention. Accordingly, it is intended that the appended claims cover all such variations as fall within the spirit and scope of the invention.

What is claimed is:

1. Apparatus for mechanically and electrically connecting a device to a panel comprising:

a carrier panel having an aperture therein;

a floating connector block received in said aperture, said block including a main body and including at least two pairs of longitudinally spaced flanges extending from said main body in planes parallel with the plane of said aperture, said carrier panel being disposed between the flanges of each of said pairs of flanges, said floating connector block further including a plurality of terminal means within said main body oriented substantially perpendicular to said flanges for establishing electrical connections;

a plurality of resilient support strips extending between the flanges of each of said pairs of flanges such that said strips are tensioned under contact with said carrier panel to locate said floating connector block at a desired position within said aperture;

a device-end connector including a plurality of pin means arranged for connection with said terminal means; and guide means for aligning said terminal means and said pin means when said device-end connector and said floating connector block are brought together.

2. The apparatus of claim 1 wherein said guide means comprises:

a locating projection extending from said device-end connector substantially parallel to said pin means and for a distance such that it reaches said floating block connector before said pin means and said terminal means make contact; and a guide receptacle in said floating connector block for receiving said locating projection.

3. The apparatus of claim 1 wherein said carrier panel comprises a tray for supporting said device, said vertical portion being located at the rear of said tray, and said device-end connector being rigidly mounted to the rear of said device.

4. The apparatus of claim 3 wherein the upper edge of said aperture includes a pair of tabs and the upper edge of said vertical portion of said carrier panel includes an open area leading to said aperture.

5. The apparatus of claim 1 wherein said flanges include receiving grooves in their upper and lower edges and wherein said resilient strips are comprised of a pair of O-rings, each O-ring being received in said receiving grooves of a respective pair of flanges.

6. The apparatus of claim 1 further comprising a wire bundle connected to said terminal means.

7. The apparatus of claim 1 wherein said pin means is comprised of a plurality of male terminal pins and wherein said terminal means is comprised of a plurality of female terminal sockets.

8. Apparatus for mechanically and electrically connecting a device to a panel comprising:

a carrier panel having an aperture therein;

a floating connector block received in said aperture, said block including a main body and including at least two pairs of longitudinally spaced flanges extending from said main body in planes parallel with the plane of said aperture, said carrier panel being disposed between the flanges of each of said pairs of flanges, said floating connector block further including a plurality of terminal means within said main body oriented substantially perpendicular to said flanges for establishing electrical connections;

a plurality of resilient support means engaging said floating connector block and said panel for locating said floating connector block at a desired position within said aperture;

a device-end connector including a plurality of pin means arranged for connection with said terminal means;

tray means on said panel for supporting said device with said terminal means and said pin means being oriented in general alignment prior to interconnection; and guide means for precisely aligning said pin means and said terminal means for interconnection when said device-end connector and said floating connector block are brought together.

9. A connector apparatus comprising:

a floating block having a longitudinal axis and having a lateral dimension $d_1$, said floating block including terminal means parallel to said longitudinal axis for establishing electrical connections;

a carrier panel having a thickness $d_2$ and having an aperture therein for receiving said floating block, said aperture having a lateral dimension $d_3$ greater than $d_1$;

a first pair of longitudinally spaced flanges extending a distance $d_5$ from said floating block perpendicular to said longitudinal axis and separated by a distance $d_4$ greater than $d_2$, said flanges of said first pair being disposed on opposite sides of said carrier panel;

a second pair of longitudinally spaced flanges extending a distance $d_6$ from said floating block and separated by said distance $d_4$, said flanges of said second pair being disposed on opposite sides of said carrier panel, the sum of $d_1$, $d_5$, and $d_6$ being greater than $d_3$;

a plurality of resilient support strips extending between the flanges of each of said pairs of flanges such that said strips engage said carrier panel and tend to locate said floating block at a desired position within said aperture; and a device-end connector including pin means for connecting with said terminal means.

10. The apparatus of claim 9 further comprising:

guide means for aligning said pin means and said terminal means when said device-end connector and said floating block are brought together.

11. The apparatus of claim 9 further comprising:

a block inserting passage in said carrier panel communicating with said aperture, said passage having a width $d_7$ greater than $d_1$ and less than $d_3$.

12. The apparatus of claim 9 wherein said flanges include receiving grooves in their upper and lower edges and wherein said resilient strips are comprised of a pair of O-rings each disposed in receiving grooves of a respective pair of flanges, said O-rings being separated by a distance slightly greater than $d_3$ such that said O-rings are tensioned under contact with said carrier panel.

13. The apparatus of claim 10 wherein said guide means comprises:

a locating projection extending from said device-end connector along said longitudinal axis; and a guide slot in said floating block for receiving said locating projection.

14. The apparatus of claim 9 wherein said pin means is comprised of a plurality of male pins and wherein said terminal means is comprised of a plurality of female terminal sockets.

15. A method for installing an electrical device to a carrier panel comprising the steps of:

providing a floating block having a longitudinal axis and having a lateral dimension $d_1$;

providing terminal means in said floating block parallel to said longitudinal axis for establishing electrical connections;

providing a carrier panel of thickness $d_2$ having an aperture therein, said aperture having a lateral dimension $d_3$ greater than $d_1$;

providing a first pair of longitudinally spaced flanges extending a distance $d_5$ from said floating block perpendicular to said longitudinal axis and separated by a distance $d_4$ greater than $d_2$;

providing a second pair of longitudinally spaced flanges extending a distance $d_6$ from said floating block perpendicular to said longitudinal axis and separated by said distance $d_4$, the sum of $d_1$, $d_5$, and $d_6$ being greater than $d_3$;

providing aligned receiving grooves in the upper and lower edges of said flanges;

inserting a respective O-ring in the grooves of each respective pair of flanges;

inserting said floating block into said aperture such that said carrier panel is disposed between the flanges of each of said pairs of flanges and said O-rings are tensioned under contact with said carrier panel;

providing a device-end connector on said device including pin means extending parallel to said longitudinal axis;

orienting said device and said carrier panel such that said terminal means and said pin means are substantially aligned; and joining said device-end connector and said floating block by relative axial movement until said terminal means and said pin means are coupled.

16. The method of claim 15 wherein said carrier panel includes a block inserting passage communicating with said aperture and having at its narrowest point a width $d_7$ greater than $d_1$ and less than $d_3$ and having a widening slope at its upper end, and wherein said step of inserting said floating block into said aperture comprises the steps of:

retracting said O-rings toward said floating block by inserting said floating block into said passage; and moving said floating block into said aperture thereby releasing said O-rings.

17. The method of claim 15 wherein said device-end connector includes a locating projection extending parallel to said longitudinal axis and said floating block includes a guide slot for aligning said block pin means and said terminal pin means, and wherein said orienting step is comprised of the insertion of said locating projection into said guide slot.

* * * * *